US008016557B2

(12) United States Patent
Abdelwahab et al.

(10) Patent No.: US 8,016,557 B2
(45) Date of Patent: Sep. 13, 2011

(54) AIRFOIL DIFFUSER FOR A CENTRIFUGAL COMPRESSOR

(75) Inventors: Ahmed Abdelwahab, Grand Island, NY (US); Gordon J. Gerber, Boston, NY (US)

(73) Assignee: Praxair Technology, Inc., Danbury, CT (US)

( * ) Notice: Subject to any disclaimer, the term of this patent is extended or adjusted under 35 U.S.C. 154(b) by 1023 days.

(21) Appl. No.: 11/903,592

(22) Filed: Sep. 24, 2007

(65) Prior Publication Data

US 2008/0038114 A1 Feb. 14, 2008

Related U.S. Application Data

(63) Continuation-in-part of application No. 11/199,254, filed on Aug. 9, 2005, now Pat. No. 7,448,852.

(51) Int. Cl.
*F04D 29/44* (2006.01)

(52) U.S. Cl. ..... 415/208.3; 415/211.2

(58) Field of Classification Search ..... 415/208.3, 415/208.2

See application file for complete search history.

(56) References Cited

U.S. PATENT DOCUMENTS

| | | | |
|---|---|---|---|
| 2,372,880 | A | 4/1945 | Browne |
| 4,900,225 | A | 2/1990 | Wulf et al. |
| 4,978,278 | A | 12/1990 | Kun |
| 4,982,889 | A | 1/1991 | Eardley |
| 5,046,919 | A | 9/1991 | Wulf |
| 5,368,440 | A | 11/1994 | Japikse et al. |
| 5,529,457 | A | 6/1996 | Terasaki et al. |
| 5,730,580 | A | 3/1998 | Japikse |
| 5,901,579 | A | 5/1999 | Mahoney et al. |
| 6,582,185 | B2 | 6/2003 | Lippert et al. |

FOREIGN PATENT DOCUMENTS

JP 2004027932 A * 1/2004

OTHER PUBLICATIONS

Denton, et al., "The exploitation of three-dimensional flow in turbomachinery design", Proceedings of the Inst. of Mechanical Engineers, vol. 213, Part C (1999).

Abdelwahab, "An Airfoil Diffuser with Variable Stagger and Solidity for Centrifugal Compressor Applications", Proceedings of GT2007, ASME Turbo Expo 2007; Power for Land, Sea and Air, Montreal Canada (2007) pp. 1-11.

* cited by examiner

*Primary Examiner* — Richard Edgar
(74) *Attorney, Agent, or Firm* — David M. Rosenblum

(57) ABSTRACT

An airfoil diffuser for a centrifugal compressor formed by a diffuser passage area and a plurality of diffuser blades located within the diffuser passage area. The diffuser passage area is defined between a hub plate and a shroud of the centrifugal compressor. Each of the diffuser blades has a twisted configuration in a stacking direction as taken between the hub plate and an outer portion of the shroud located opposite to the hub plate. As a result of the twisted configuration, the diffuser blade inlet blade angle decreases from the hub plate to the outer portion of the shroud and solidity measurements at leading edges of the diffuser plates vary between a lower solidity value measured at the hub plate of less than 1.0 and a high solidity value measured at the outer portion of the shroud of no less than 1.0.

15 Claims, 4 Drawing Sheets

AIRFOIL DIFFUSER FOR A CENTRIFUGAL COMPRESSOR

RELATED APPLICATIONS

This application is a continuation-in-part of U.S. patent application Ser. No. 11/199,254, now U.S. Pat. No. 7,448,852 filed Aug. 9, 2005.

TECHNICAL FIELD

The present invention relates to an airfoil diffuser for a centrifugal compressor that incorporates a plurality of diffuser blades located within a diffuser passage area in which each of the diffuser blades has a twisted configuration in a stacking direction. More particularly, the present invention relates to such an airfoil diffuser in which the solidity values measured at the leading edges of the blades of the airfoil diffuser varies between values that are less than 1.0 at a hub plate of the compressor to over 1.0 as measured at an outer portion of the shroud of the compressor located opposite to the hub plate.

BACKGROUND OF THE INVENTION

Centrifugal compressors are utilized in a number of industrial applications. The major components of a centrifugal compressor are the impeller which is driven by a power source, typically an electric motor. The impeller rotates within an inner annular region of a hub plate and adjacent to a shroud. The impeller is a rotating bladed element that draws the fluid to be compressed through the shroud and redirects the flow at high velocity and therefore kinetic energy in a direction that is generally radial to the direction of rotation of the impeller. A diffuser is located downstream of the impeller within a diffuser passage area defined between the hub plate and an outer portion of the shroud to recover the pressure in the gas by decreasing the velocity of the fluid to be compressed. The resulting pressurized fluid is directed towards an outlet of the compressor.

In vaneless diffusers, the diffuser passage area between the hub plate and the outer portion of the shroud is ever increasing to recover the pressure. In vane-type diffusers, blades are connected to the hub plate or the outer portion of the shroud in the diffuser passage area. The blades can have a constant transverse cross-section as viewed from hub plate to shroud. In vane-type diffusers, known as airfoil diffusers, the vanes have an airfoil section rather than a constant transverse cross-section.

The power that is required to drive such a centrifugal compressor can represent a considerable portion of the running cost of the plant in which the centrifugal compressor is employed. For example, in an air separation plant, most of the costs involved in operating the plant are electrical power costs used in compressing the air. Compressors employed in such applications as air separation, but other applications as well, require a wide operating range. For example, in an air separation plant, it is necessary to be able to turn down the production and to raise the production. This variable operation can be driven by demand or local electrical power costs which will vary depending on the time of day. However, given the cost of electrical power, it is also necessary that the wide operating range be accompanied by compressor efficiency over the operating range.

In an attempt to increase the operating range while retaining efficiency, it is possible to alter impeller design and diffuser design. With respect to impeller design, however, the actual design employed is constrained by the mechanical arrangement of the compressor and the resulting flow conditions, for instance specific speeds. These arrangements, lead to a predetermination of many of the impeller characteristics, for instance, the design of the impeller shroud and inducer arrangements, axial length and therefore, meridional profile and the use of three-dimensional aerodynamic configurations, namely aerodynamic sweep and lean and the use of splitter blades. Typically, however, the most commonly used impeller characteristic is blade backsweep at the impeller exit. This gives the centrifugal stage a rising pressure characteristic with decreased flow rates which increases the stability of the stage. Furthermore, compared to a radial bladed impeller designed at the same rotation speed and pressure ratio, a backswept impeller has lower blade pressure loading as compared to a radial bladed impeller design, increased impeller reaction and increased loss free energy transfer (Coriolis acceleration) to the fluid.

The diffuser design is less constrained than the impeller. The geometrical constraint for the diffuser design being the size of the volute and collector for overhung stages, or return channel in the case of beam type stages. Vaneless diffusers are able to provide the centrifugal compressor stage with large operating ranges at moderate pressure recovery levels and at moderate efficiencies. Vane-type diffusers, on the other hand, have a higher efficiency level but at reduced ranges. In an attempt to increase the range of operation, U.S. Pat. No. 2,372,880 provides a vane-type diffuser having blades without an airfoil transverse cross-section but with a twist built into the blades to change the throat area and thereby to increase the operating range of the compressor. The resulting diffuser is a high solidity diffuser or in other words geometrically incorporates a ratio, calculated by dividing a distance measured between the leading and trailing edges of the blades by the circumferential spacing between leading edges of adjacent blades, that is greater than 1.0.

Low solidity diffusers, that is airfoil diffusers with a solidity value of less than 1.00 are characterized by the absence of a geometrical throat in the diffuser passage and have proven to possess a large flow range, similar to vaneless diffusers, but at increased pressure recovery levels over vaneless diffusers. The increased range in operation, however, has been found to be at the expense of efficiency compared to high solidity diffusers. At the other extreme, high solidity diffusers have been constructed, that while more efficient, do not possess the operating range of low solidity diffusers.

As will be discussed, in the present invention, in one aspect, provides an airfoil diffuser in which the diffuser blades are fabricated with a twisted configuration that produce a low solidity value at the hub plate and a high solidity value at the shroud with the result that the diffuser imparts to this centrifugal compressor not only a wider operating range but also high efficiency over the wide operating range as compared to the prior art.

SUMMARY OF THE INVENTION

The present invention provides an airfoil diffuser for a centrifugal compressor in which the solidity varies from a low solidity value at the hub plate to a high solidity value at the shroud. In accordance with the present invention, the airfoil diffuser has a diffuser passage area defined between a hub plate and an outer portion of a shroud located opposite to the hub plate. The hub plate and the shroud form part of the centrifugal compressor and each has a generally annular configuration to permit an impeller of the centrifugal compressor to rotate within an inner annular region thereof. A plurality of diffuser blades are located within the diffuser passage area between the hub plate and the outer portion of the shroud in a circular arrangement and are connected to the hub plate or the outer portion of the shroud.

The diffuser blades have a twisted configuration in a stacking direction as taken between the hub plate and outer portion of the shroud such that for each of the diffuser blades, inlet blade angle decreases from the hub plate to the outer portion of the shroud and lean angle in each of the diffuser blades measured at the hub plate is at a negative value at the leading edge and a positive value at the trailing edge as viewed in the direction of impeller rotation. It is to be noted, that as used herein and in the claims, the term, "stacking direction" means a span-wise direction of each of the diffuser blades along which an infinite number of airfoil sections are stacked from the hub plate to the outer portion of the shroud. The term "inlet blade angle" means an angle measured between a tangent to a circular arc passing through the blades at the point of measurement along the leading edge, for example at the hub plate and the outer portion of the shroud, and a tangent to the camber line of the diffuser blade passing through the leading edge thereof. The term "lean angle" as used herein and in the claims is the angle that each of the diffuser blades makes in its span-wise direction with a line normal to the hub plate as measured at the hub plate. As a matter of convention, such angle has a positive value in the direction of impeller rotation.

In an airfoil diffuser of the present invention, solidity measurements at the leading edges of the diffuser blades vary between a lower solidity value measured at the hub plate of less than 1.0 and a higher solidity value measured at the outer portion of the shroud of no less than 1.0. In this regard, the term, "solidity value" means a ratio between the chord line distance or in other words, the distance separating the leading and trailing edges of each of the diffuser blades divided by the circumferential spacing of the blades at the leading edges of the blades. The circumferential spacing and the chord line distance are determined at the location at which the measurement is to be taken, at the hub plate and at the outer portion of the shroud. Without blade sweep, the circumferential distance will be the same.

Preferably, the lower solidity value is in a lower range of between about 0.5 and about 0.95 and the higher solidity value is in a higher range of between about 1.0 and about 1.4. Most preferably, the lower solidity value is about 0.8 and the higher solidity value is about 1.3. The inlet blade angle can vary in a linear relationship with respect to the stacking direction. Preferably, each of the diffuser blades is twisted about a line that generally extends in a stacking direction that passes through the aerodynamic center of each airfoil section.

The absolute value of the lean angle is preferably no greater than about 75 degrees. Preferably, the inlet blade angle as measured at the hub plate is between 15.0 degrees and about 50.0 degrees and as measured at the outer portion of the shroud is between about 5.0 degrees and about 25.0 degrees. The camber angle at both the hub plate and the outer portion of the shroud for each of the diffuser blades is between about 0.0 degrees and about 30 degrees, preferably between about 5 degrees and about 10 degrees. In this regard, as used herein and in the claims, the term "camber angle" means the angle made between a tangent to the camber line of the diffuser blade that passes through the leading edge of the diffuser blade and a tangent to the camber line of the diffuser blade that passes through the trailing edge of the blade.

Preferably, each of the diffuser blades has a NACA 65 airfoil section. Further, each of the diffuser blades has a maximum thickness to chord ratio of between about 2 percent and about 6 percent as measured at the outer portion of the shroud and the hub plate, respectively. In this regard, a maximum thickness to chord ratio of about 0.045 as an average between measurements taken at the outer portion of the shroud and the hub plate is preferred.

Preferably, the diffuser blades at the leading edges thereof are offset at a constant offset from an inner radius of the hub plate as measured at the hub plate of between about 5.0 percent and about 25.0 percent of an impeller radius of the impeller used in connection with the airfoil diffuser. A preferred constant offset is about 15.0 percent. The term "offset" as used herein and in the claims means a percentage of the impeller radius. There can be between about 7 and 19 diffuser blades, preferably 9 diffuser blades. Both the leading edge and the trailing edge can be configured without sweep.

BRIEF DESCRIPTION OF THE DRAWINGS

While the specification concludes with claims distinctly pointing out the subject matter that applicants regard as their invention, it is believed that the invention will be better understood when taken in connection with a description of the accompanying drawings in which:

DETAILED DESCRIPTION

Figure 1:
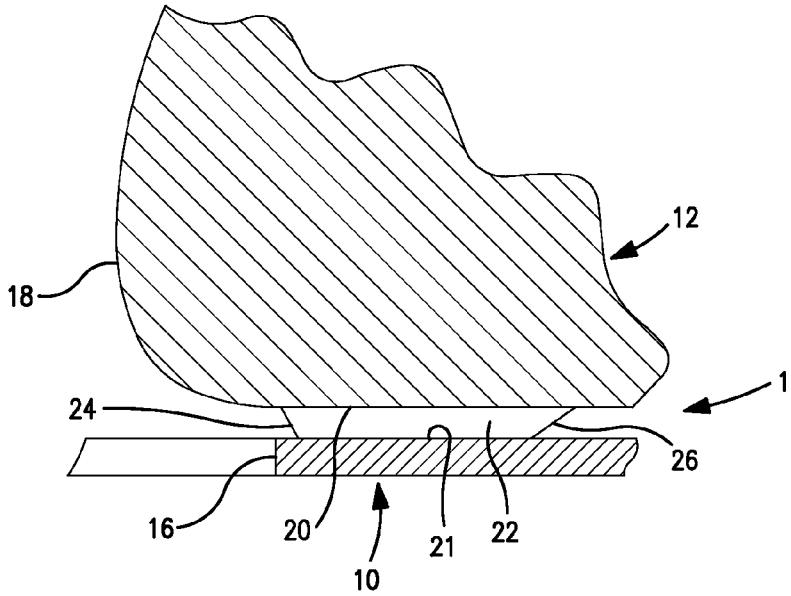
FIG. 1 is a fragmentary, elevational view of an airfoil diffuser in accordance with the present invention.
Figure 2:
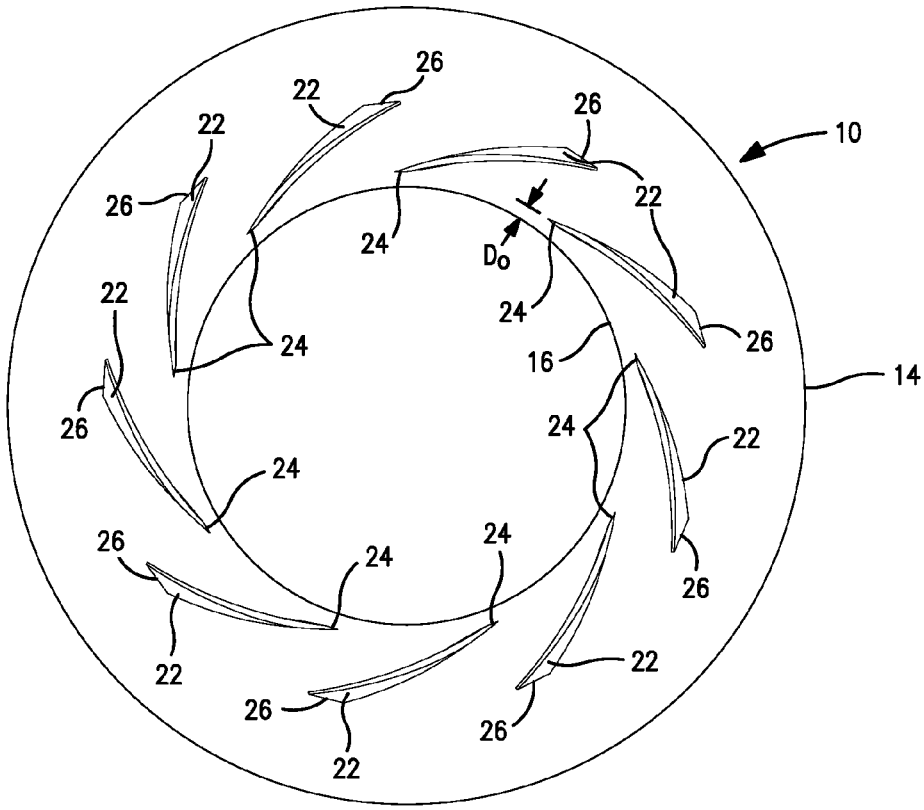
FIG. 2 is a plan view of a hub plate of an airfoil diffuser in accordance with the present invention that is in part illustrated in elevation in FIG. 1.

With reference to FIGS. 1 and 2, an airfoil diffuser 1 in accordance with the present invention is illustrated. Airfoil diffuser 1 is incorporated into the centrifugal compressor between a hub plate 10 and a shroud 12 thereof. Both the hub plate 10 and the shroud 12 have a generally annular configuration to permit an impeller of the centrifugal compressor to rotate within an inner annular region thereof. As such, hub plate 10 has a circular outer periphery 14 and a circular inner periphery 16. Shroud 12 has a contoured inlet portion 18 through which a gas to be compressed is drawn into the impeller and an outer portion 20 located opposite to the hub plate 10 that radially extends from the inlet portion 18. As known in the art, shroud 12 forms part of the compressor casing and the hub plate 10 is connected in such compressor casing. The airfoil diffuser 1 is formed by a diffuser passage area 21 that is defined between the hub plate 10 and outer portion 20 of the shroud 12 and diffuser blades 22. Although not illustrated, diffuser passage area 21 is in communication with the compressor outlet from which compressed gas is discharged via a volute or return channel. Diffuser blades 22 are connected to the hub plate 10 and are thus located between the hub plate 10 and the outer portion 20 of shroud 12. It is possible to connect the diffuser blades 22 to the portion 20 of shroud 12. As can best be seen in FIG. 2, the diffuser blades 22 are positioned in a circular arrangement.

Although not illustrated, an impeller is positioned for rotation in the circular inner periphery 16 of hub plate 10 and in a close relationship to the contoured inlet portion of the shroud 12. Although the present invention can be used with any impeller design, an impeller incorporating backsweep at the impeller exit is preferred. It is also to be noted that the present invention has application to any centrifugal compressor without regard to the particular manufacturer.

Figure 3:
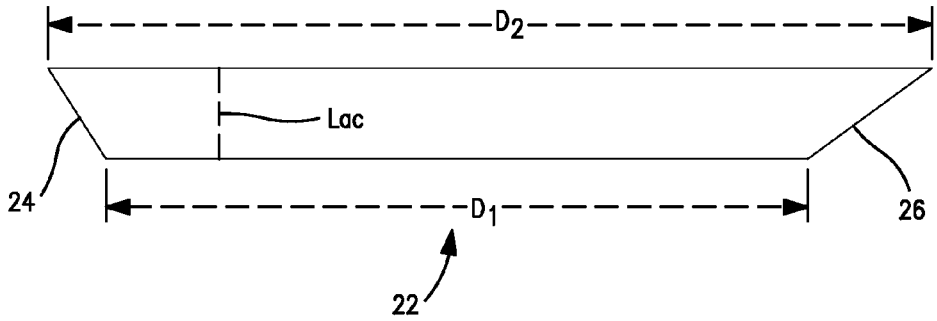
FIG. 3 is an enlarged, fragmentary elevational view of a diffuser blade incorporated into the hub plate shown in FIG. 2.

As is apparent from FIG. 2, it can be seen that each of the diffuser blades has a twisted configuration in a stacking direction. With additional reference to FIG. 3, each of the diffuser blades 22 has a leading edge 24 and a trailing edge 26. Since each of the diffuser blades 22 incorporates an airfoil section, it also has a chord line between the leading and trailing edges 24 and 26. The chord line distance or in other words, the distance separating the leading and trailing edges 24 and 26 of each of the diffuser blades 22 at the juncture of each of the diffuser blades 22 with the hub plate is given by the chord line distance "D1". The chord line distance separating the leading and trailing edges 24 and 26 where each of the diffuser blades 22 meets the outer portion 20 of shroud 12 is illustrated as distance "D2". Although not illustrated, at such junctures between the diffuser blades 22 and the hub plate 10, fillets are provided for a smooth transition between blade and plate.

Figure 4:
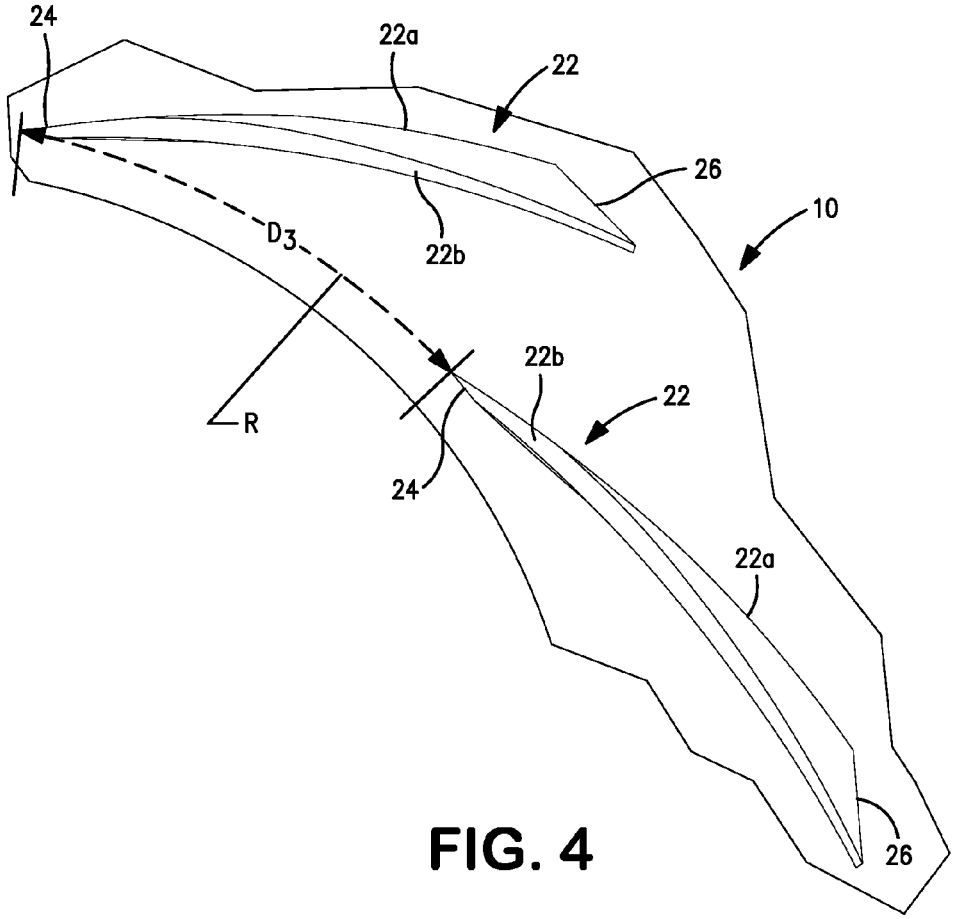
FIG. 4 is an enlarged, fragmentary plan view of the hub plate illustrated in FIG. 2.

With additional reference to FIG. 4, at the leading edge 24 of each of the diffuser blades 22, a spacing between the blades 22, namely, the circumferential distance separating the diffuser blades 22 can be measured at the hub plate 10 and the outer portion 20 of the shroud 12. This circumferential distance along an arc having a radius "R" separating the diffuser blades 22 is given by "D3". "D3" in the illustrated embodiment can be determined by taking the circumference of the circle $2\pi R$ on which the leading edge 24 of each of the diffuser blades 22 lie and dividing such value by the number of blades. In the illustrated embodiment, this distance will not vary between the hub plate 10 and the outer portion 20 of the shroud 12 because the blades are not swept at the leading edge 24 thereof.

It is to be noted, that in the figures, namely, FIGS. 1-4, the angle of the leading edge 24 of each of the diffuser blades 22 is not a sweep angle, but rather, an angle that appears due to the twist imparted into the diffuser blades 22 as viewed in such figures. As would be known in the art, the term "sweep" as used in connection with leading edges of airfoil diffuser blades means that the point at which each of the leading edges of the diffuser blades contacts the hub plate 10 is at a different radius than the point at which each of the leading edges of the diffuser blades contact the outer portion 20 of the shroud 12. The same definition would apply to the trailing edges which could similarly be provided with a sweep, but are not swept in the illustrated embodiment.

As can best be seen in FIG. 2, leading edges 24 are located at a constant offset distance "$D_o$" from the inner circumference 16 of the hub plate 10. This offset can be expressed as a percentage of a radius of the impeller rotating within the inner circumference 16 of hub plate 10 and is preferably between about 5 percent and about 25 percent of such radius. A constant offset of 15.0 percent is preferred. The reason for the offset is that if the leading edges 24 were placed at inner circumference 16, then a flow induced structural vibration may be set up in the impeller blades and the diffuser blades 22 from the flow leaving the impeller that may weaken the impeller blades and the diffuser blades 22. However, at too far an offset distance, the interaction between the flow and the diffuser blades 22 will decrease to an extent that the diffuser 1 performance may deteriorate to a vaneless diffuser performance in terms of its efficiency and pressure recovery capability. Typically, there can be between about 7 and 19 of the diffuser blades 22, although 9 such diffuser blades 22 are preferred.

In order to obtain maximum efficiency as well as operating range, the solidity value as measured at leading edges 24 of each of the diffuser blades 22 at the hub plate 10 is less than 1.0 and the solidity value measured at the outer portion 20 of shroud 12 of 1.0 and greater. With specific reference to FIGS. 3 and 4, the lower solidity value at hub plate 10 is computed from a ratio of "D1" to "D3" and the higher solidity value measured at the outer portion 20 of the shroud 12 is computed from a ratio of "D2" to "D3". Preferably, the lower solidity value is in the range of between about 0.5 and about 0.95. The higher solidity value is in a higher range of between about 1.0 and about 1.4. Even more preferably, the lower solidity value is 0.8 and the higher solidity value is 1.3.

Figure 5:
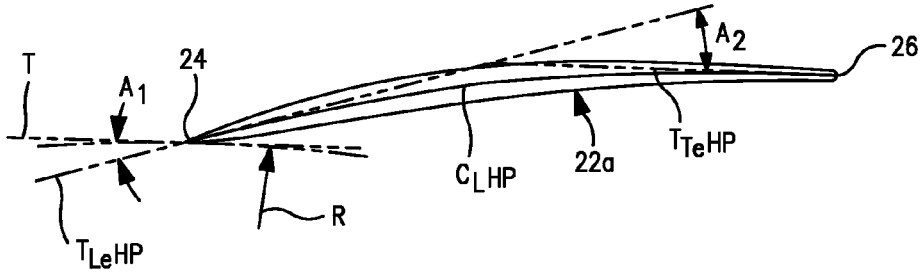
FIG. 5 is an enlarged plan view of the outline of a blade of an airfoil diffuser in accordance with the present invention taken at the hub plate to illustrate the inlet blade angle and the camber angle of each of the blades at the hub plate.
Figure 6:
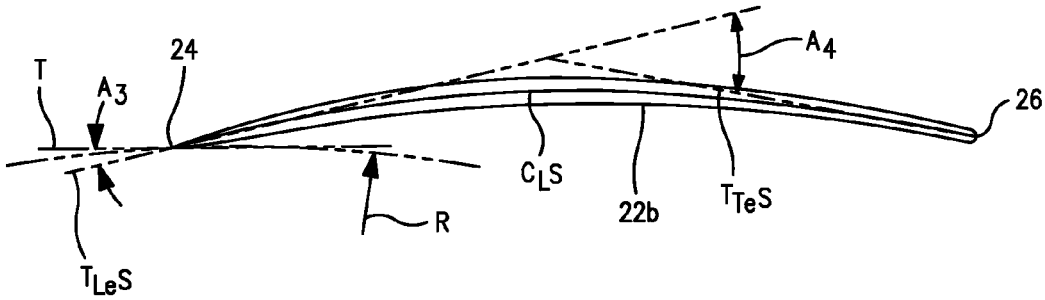
FIG. 6, is an enlarged plan view of the outline of a blade of an airfoil diffuser in accordance with the present invention taken at the outer portion of the shroud to illustrate the inlet blade angle and the camber angle of each of the blades at the outer portion of the shroud.

Given that the blades are of twisted configuration, diffuser blade inlet blade angle will decrease in the stacking direction, from the hub plate 10 to outer portion 20 of the shroud 12. With reference to FIG. 5, the inlet blade angle "A1" of a diffuser blade 22 where it meets the hub plate 10 is measured between a tangent line "T" to the circle given by the radius "R", previously discussed, and a tangent "$T_{Le}^{HP}$" to the camber line "$C_L^{HP}$" of the airfoil section at blade outline 22*a* passing through the leading edge 24 thereof. It is to be noted that the camber angle, "A2" of the airfoil section at blade outline 22*a* is the angle between tangent "$T_{Le}^{HP}$" and a tangent "$T_{Te}^{HP}$" to the camber line "$C_L^{HP}$" passing through the trailing edge 26 thereof. With reference to FIG. 6, the inlet blade angle "A3" of a diffuser blade 22 where it meets the hub plate 10 is measured between the tangent line "T" to the circle given by the radius "R", previously discussed, and a tangent "$T_{Le}^{S}$" to the camber line "$C_L^{S}$" of the airfoil section at blade outline 22*b* passing through the leading edge 24 thereof. Again, it is also to be noted that the camber angle, "A4" of the airfoil section at blade outline 22*b* is the angle between tangent "$T_{Le}^{S}$" and a tangent "$T_{Te}^{S}$" to the camber line "$C_L^{S}$" passing through the trailing edge 26 thereof. As is apparent from FIGS. 5 and 6 angle "A1" is greater than angle "A3".

The inlet blade angle "A1" as measured at the hub plate 10 is preferably between about 15.0 degrees and about 50.0 degrees and as measured at the outer portion 20 of the shroud 12, inlet blade angle "A3" is preferably between about 5.0 degrees and about 25.0 degrees. In addition the camber angle at both the hub plate 10 and the outer portion 20 of the shroud 12 is between about 0.0 and about thirty degrees. It has been found by the inventors herein that inlet blade angle is selected on the basis of the impeller and the induced inlet flow to the airfoil diffuser. The camber angle, "A2" or "A4", is preferably between about 5.0 and about 10.0 degrees.

The choice of the flow angles used for the diffuser blade design, for instance the inlet blade angle and the camber angle, will depend on impeller design and the diffuser diffusion schedule. Typically, modern airfoil design is accomplished with the use of computer assisted packages that utilize computational fluid dynamics and are all well known by those skilled in the art. The outer ranges of these angles represent known variations in impeller designs that are used in connection with centrifugal impellers and represent a range at which the flow leaving the impeller may be redirected in the diffuser with pressure recovery. Generally speaking, with respect to the inlet blade angle, since the flow at the shroud is generally more tangential, there is a smaller angle variation allowed.

With reference again to FIG. 3, each of the diffuser blades 22 is preferably twisted about a line "$L_{ac}$" that is a line in the stacking direction that passes through the aerodynamic center of each of the diffuser blades. The aerodynamic center is a point around which the aerodynamic moment does not vary with the angle of attack of the blades. It is to be noted, that this is preferred and embodiments of the present invention can also be produced with a twist about some other location of the diffuser blades 22.

Figure 7:
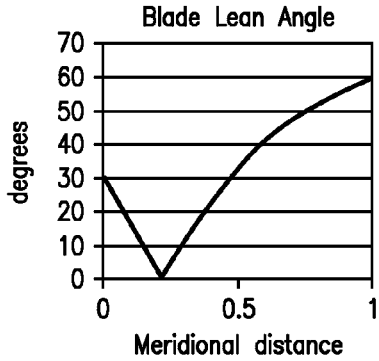
FIG. 7 is a graphical representation of the absolute value of lean angle incorporated into blades of a diffuser in accordance with the present invention and shown in FIGS. 1-5 versus meridional distance along the diffuser blade.

The blade twist produces a lean angle in each of the diffuser blades 22 that is measured from a normal line to the hub plate 10 and in direction of rotation of the impeller (clockwise in FIG. 2) that is negative at the leading edge 24 and positive at the trailing edge. Preferably, the absolute lean angle is no greater than about 75 degrees. This is for manufacturing purposes in that greater lean angles have been found to be difficult to machine. With reference to FIG. 7, in the illustrated embodiment, the lean angle is about −30 degrees at each of the leading edges 24, drops to zero at "$L_{ac}$" and then increases to about 60 degrees at each of the trailing edges 26. It is to be noted that the term "Meridional distance" is a percent distance of a camber line of the airfoil section incorporated into the diffuser blades 22 that lies between the suction and pressure surfaces of such airfoil.

Preferably, each of the diffuser blades 22 incorporates a NACA 65 airfoil section. The range of maximum thickness to chord ratios of such airfoil is about 2 percent as measured at the outer portion 20 of the shroud 12 and is about 6 percent as measured at the hub plate 10. As known in the art, such ratio is determined by taking the maximum thickness of the blades between the pressure and suction surfaces and dividing the same by the chord line distance. For example, with respect to the thickness to chord ratio at the hub plate 10, the value would be the maximum thickness of blade outline 22*a* shown in FIG. 5 divided by distance "D1" shown in FIG. 3. In the illustrated diffuser blades 22, the change in this ratio is linear, but could be non-linear. As can be appreciated, since the solidity is increasing from the hub plate 10 to the outer portion 20 of the shroud 12, the chord of each of the diffuser blades 22 is also increasing and therefore in order to maintain a constant maximum thickness, to avoid flow separation, in a stacking direction of each of the diffuser blades 22 towards the outer portion 20 of the shroud 12, the ratio is decreasing. The average of the thickness to chord ratio at the shroud and the hub plate is preferably 0.045.

The following Table I specifies experimental results of maximum isentropic efficiency of diffuser blades of a variety of different designs. Blade Type 2 is a pure lean design and Blade Type 8 has no twist and as such there is no Stacking Location for Blade Twist. The "Stacking Location for Blade Twist" indicates, as a percentage of camber line distance from the leading edge of the blade, the location of a line about which a particular blade was twisted. In all cases, the "Stacking Location of Blade Twist" was not at the aerodynamic center. Blades 1, 2 and 7 are high solidity designs in that the solidity is 1 or greater. Blades 3, 5, 6 and 8 are low solidity blade designs in that the solidity is less than 1. Blade Type 5 that had a solidity value of less than 1.00 at the hub plate and a solidity value of greater than 1.00 at the shroud and is a blade in accordance with the present invention in that the placement of the Stacking Location of Blade Twist at the aerodynamic center is a preferred but not mandatory feature of the present invention. As expected, Blade Type 4 had the highest peak isentropic peak efficiency of all the blades tested and set forth in Table I. It is to be noted that all airfoils were NACA 65 type sections.

TABLE I

| Blade Type | 1 | 2 | 3 | 4 | 5 | 6 | 7 | 8 |
|---|---|---|---|---|---|---|---|---|
| Stacking Location of Blade Twist | 50% | None | 50% | 45% | 0% | 0% | 0% | None |
| Lean Angle Distribution | −30° to +30° | −27° to +35° | −25° to +30° | −8° to +13° | 0° to +42° | 0° to +45° | 0° to +35° | 0° |
| Inlet to Exit Variation of Solidity Ratio from Hub to Shroud | 1.4 to 1.5 | 1.0 to 1.0 | .78 to .93 | .97 to 1.005 | .89 to .98 | .87 to .96 | 1.5 to 1.7 | .93 |
| Inlet Blade Angle Variation from Hub to Shroud | 21.8° to 19.7° | 16.8° to 16.8° | 16.8° to 14.0° | 21.4° to 20.6° | 19° to 15° | 18.5 to 13.0° | 21.9° to 19.0° | 18.1° |
| Camber Angle Variation from Hub to Shroud | 5° to 12° | 13° to 13° | 13° to 12° | 9° to 9° | 12 to 11° | 13 to 12° | 7° to 6° | 7° |
| Tested Peak Isentropic Efficiency | 83% | 82% | 82.5% | 85% | 83% | 82% | 84.5% | 82% |

Table II illustrates blades that were all in accordance with the present invention and that included the preferred Stacking Location of Blade Twist at the aerodynamic center as well as other preferred features. All blades were again based upon NACA 65 type sections. Here the peak isentropic efficiencies were greater than in Table II, except for "Blade Type" 11 in which the efficiency suffered due to the fact that impeller diameter was about 20 percent less than type 9. However, this is in fact a significant efficiency given the fact that smaller impellers are inherently less efficient. It is also to be noted that in comparing Tables I and II, although the percentile differences in efficiency are a few percentage points, these results are significant because the technology involved in prior art blade designs is already well developed and in any case any increase in efficiency results in significant electrical power consumption savings. In this regard, with respect to centrifugal process compressors, a change of a 1.5 percentage point of isentropic efficiency for a moderate size compressor stage represents a savings in electrical power of approximately twenty kilowatts per stage.

TABLE II

| Blade Type | Stacking Location of Blade Twist | Lean Angle Distribution from Inlet to Exit | Variation of Solidity Ratio from Hub to Shroud | Inlet blade Angle Variation from Hub to Shroud | Camber Angle Variation from Hub to Shroud | Tested Peak Insentropic Efficiency |
|---|---|---|---|---|---|---|
| 9 | 20% | −40° to +70° | .89 to 1.35 | 26.0° to 12.0° | 2° to 11° | 87% |
| 10 | 25% | −30° to +60° | .88 to 1.1 | 18.8° to 13.3° | 12.3° to 12.5° | 86% |
| 11 | 25% | −45° to +30° | .92 to 1.4 | 23.0° to 11.0° | 7° to 12° | 85% |

In terms of operational range and efficiency, in the following examples, an airfoil diffuser in accordance with the present invention ("3D Diffuser") was compared to a low solidity airfoil diffuser ("LSA Diffuser") and a high solidity airfoil diffuser ("HSA Diffuser.") The following Table III specifies the design details of each of the aforementioned diffusers used in this comparison.

TABLE III

| | LSA Diffuser | HSA Diffuser | 3D Diffuser Hub | 3D Diffuser Shroud |
|---|---|---|---|---|
| Solidity | 0.8 | 1.16 | 0.85 | 1.1 |
| Camber angle | 11.7 | 11.7 | 12.2 | 12.5 |
| No. of blades | 9 | 13 | 9 | 9 |
| Inlet radius ratio[1] | 1.15 | 1.15 | 1.15 | 1.15 |
| Airfoil | NACA 65 | NACA 65 | NACA 65 | NACA 65 |
| Thickness to chord ratio | 0.055 | 0.055 | 0.055 | 0.035 |
| Incidence angle[2] | −1.6 | −1.6 | −1.6 | −1.1 |
| Deviation angle[3] | 5.2 | 5.2 | 5.1 | 4.9 |
| Inlet flow angle | 18 | 18 | 20 | 15 |
| Exit flow angle | 23 | 23 | 26 | 21 |

[1]The "Inlet radius ratio" is a ratio between the radius of the diffuser at the inlet side of the diffuser and the impeller exit radius.
[2]Incidence Angle is the difference between the inlet blade angle and the impeller exit flow angle.
[3]Deviation angle is the difference between the diffuser exit blade angle and the specified exit flow angle.

Figure 8:
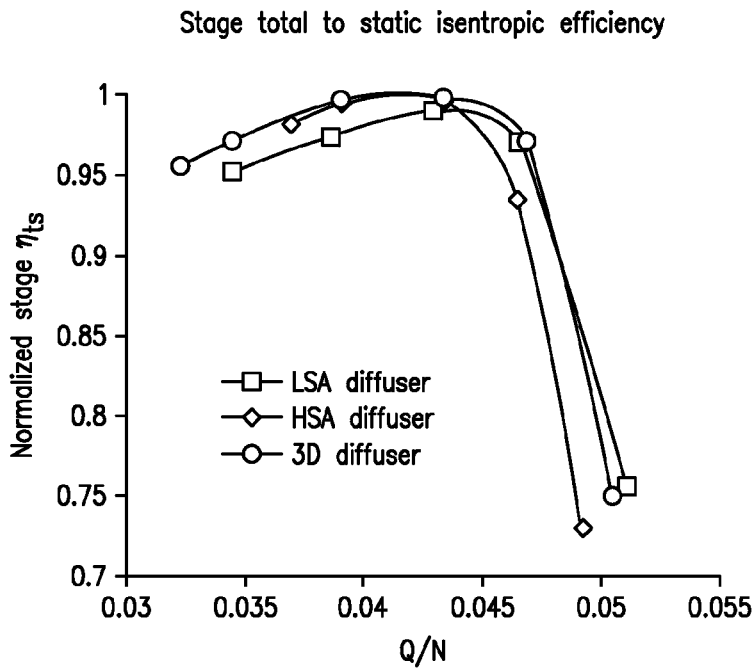
FIG. 8 is a graphical representation of the efficiency versus volumetric flow divided by impeller rotational speed of an airfoil diffuser compressor stage in accordance with the present invention as compared with low solidity and high solidity airfoil diffusers of the prior art.

With additional reference to FIG. 8, the normalized total to static stage efficiency "η" is charted against "Q/N" for the three types of airfoil diffusers specified in Table III. As well known in the art the stage total to static efficiency "$\eta_{ts}$" is given by the formula: (Stage exit static pressure/Stage inlet total pressure) $^{(\gamma/\gamma-1)-1}$ divided by ((Stage Exit Total Temperature/Stage Inlet Total temperature))−1); where "γ" is the fluid adiabatic index, which for air or nitrogen is 1.4. The quantity "Q/N" is the inlet volumetric flow divided by impeller rotational speed. A diffuser in accordance with the present invention "3D" has a peak stage efficiency similar to the peak stage efficiency of the high solidity airfoil diffuser "HSA". The peak efficiency is maintained over a wider range of flow rates. The low solidity airfoil diffuser "LSA" while exhibiting a wide operating range similar to that of an airfoil diffuser in accordance with the present invention exhibits a lower stage efficiency.

Figure 9:
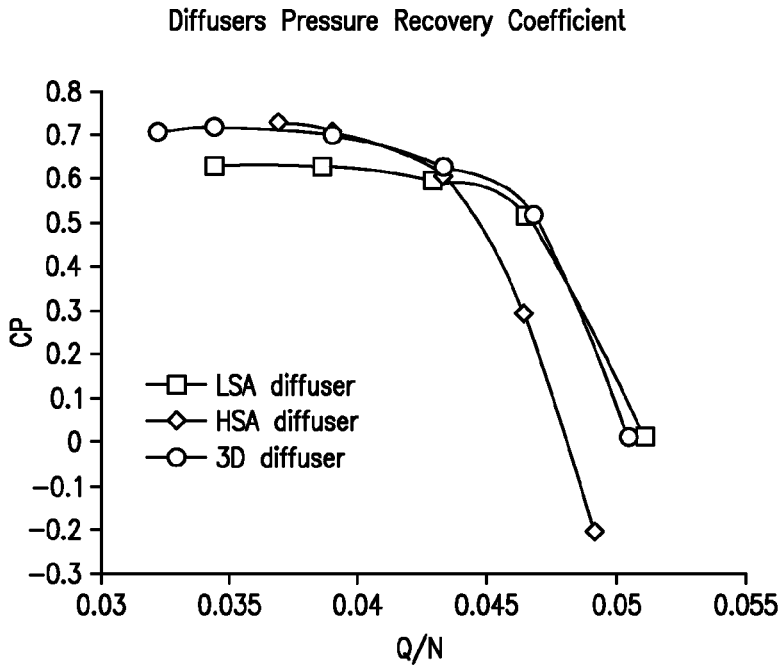
FIG. 9 is a graphical representation of the pressure recovery coefficient versus volumetric flow divided by flow velocity of an airfoil diffuser in accordance with the present invention as compared with low solidity and high solidity airfoil diffusers of the prior art.

With additional reference to FIG. 9, the pressure recovery capacity of the diffusers specified in Table III are compared. As can be seen from the graphical results shown in FIG. 9, the operating range of a diffuser in accordance with the present invention "3D" is comparable to that of the low solidity diffuser "LSA". Further, the pressure recovery coefficient "CP" of the high solidity airfoil diffuser "HSA" drops very rapidly as the flow coefficient is raised above the design point. This is due to diffuser throat choking. However, despite the high pressure recovery coefficient at design flow conditions of Q/N of 0.04 it is not maintained over a large turn down range due to flow separation at the diffuser leading edges and the consequent increase of flow blockage at the diffuser throat. Pressure recovery of the diffuser in accordance with the present invention "3D" is comparable to that of the high solidity airfoil diffuser "HSA" at design flow conditions. Furthermore, this high pressure recovery is maintained over a wider range similar to that of the low solidity diffuser. The absence of a geometrical throat due to the varying solidity combined with the blade twist and lean which set up favorable 3 dimensional flow structures in the diffuser passages allow the present invention diffuser to match the operating range of the low solidity diffuser at high pressure recoveries similar to the high solidity diffuser. For such purposes, as would be known to those skilled in the art, the term "CP" is a quantity given by the diffuser discharge pressure less the diffuser inlet pressure divided by the dynamic head at the diffuser inlet. The dynamic head at the diffuser inlet is equal to 0.05 x the inlet density x the square of the inlet flow velocity.

While the present invention has been described with reference to preferred embodiment as will occur to those skilled in the art, numerous changes and additions can be made without departing from the spirit and the scope of the present invention as set forth in the presently pending claims.

We claim:

1. An airfoil diffuser for a centrifugal compressor comprising:

a diffuser passage area defined between a hub plate and an outer portion of a shroud located opposite to the hub plate, the hub plate and the shroud forming part of the centrifugal compressor and each having a generally annular configuration to permit an impeller of the centrifugal compressor to rotate within an inner annular region thereof;

a plurality of diffuser blades located within the diffuser passage area between the hub plate and the outer portion of the shroud in a circular arrangement and connected to the hub plate or the outer portion of the shroud; and the diffuser blades having a twisted configuration in a stacking direction as taken between the hub plate and the outer portion of the shroud such that for each of the diffuser blades inlet blade angle decreases from the hub plate to the outer portion of the shroud and lean angle in each of the diffuser blades measured at the hub plate is at a negative value at the leading edge and positive value at the trailing edge as viewed in a direction of impeller rotation and solidity measurements at leading edges of the diffuser blades vary between a lower solidity value measured at the hub plate of less than about 1.0 and a higher solidity value measured at the outer portion of the shroud of no less than 1.0.

2. The airfoil diffuser of claim 1, wherein:

the lower solidity value is in a lower range of between about 0.5 and about 0.95; and the higher solidity value is in a higher range of between about 1 and about 1.4.

3. The airfoil diffuser of claim 1 wherein the lower solidity value is about 0.8 and the higher solidity value is about 1.3.

4. The airfoil diffuser of claim 3, wherein:

the leading edge and trailing edge are not swept;

the absolute lean angle is no greater than about 75 degrees as measured at the hub plate; and the inlet blade angle as measured at the hub plate is between about 15.0 degrees and about 50.0 degrees and as measured at the outer portion of the shroud is between about 5.0 degrees and about 25.0 degrees.

5. The airfoil diffuser of claim 1, wherein the inlet blade angle varies in a linear relationship with respect to the stacking direction.

6. The airfoil diffuser of claim 1, wherein each of the diffuser blades is twisted about a line generally extending in a stacking direction that passes through the aerodynamic center of each airfoil section.

7. The airfoil diffuser of claim 1, wherein the absolute value of the lean angle is no greater than about 75 degrees.

8. The airfoil diffuser of claim 1, wherein the inlet blade angle as measured at the hub plate is between about 15.0 degrees and about 50.0 degrees and as measured at the outer portion of the shroud is between about 5.0 degrees and about 25.0 degrees and the camber angle at both the hub plate and the outer portion of the shroud for each of the diffuser blades is between about 0.0 degrees and about 30 degrees.

9. The airfoil diffuser of claim 8, wherein the camber angle is between about 5 degrees and about 10 degrees.

10. The airfoil diffuser of claim 9, wherein each of the diffuser blades has a maximum thickness to chord ratio of between about 2 percent and about 6 percent as measured at the outer portion of the shroud and the hub plate, respectively.

11. The airfoil diffuser of claim 10, wherein each of the diffuser blades has a thickness to chord ratio of about 0.045 as an average between measurements taken at the outer portion of the shroud and the hub plate.

12. The airfoil diffuser of claim 11, wherein the constant offset is about 15.0 percent.

13. The airfoil diffuser of claim 1, wherein each of the diffuser blades has a NACA 65 airfoil section.

14. The airfoil diffuser of claim 1, wherein the diffuser blades at the leading edges thereof are offset at a constant offset from an inner radius of the hub plate as measured at the hub plate of between about 5.0 percent and about 25 percent of an impeller radius of an impeller used in connection with the airfoil diffuser.

15. The airfoil diffuser of claim 1, wherein there are between 7 and 19 diffuser blades.

* * * * *